US010607578B2

(12) United States Patent
Kim et al.

(10) Patent No.: US 10,607,578 B2
(45) Date of Patent: Mar. 31, 2020

(54) GUITAR WITH REPLACEABLE SOUNDBOX

(71) Applicant: Young Ae Kim, Busan (KR)

(72) Inventors: Young Ae Kim, Busan (KR); Won Sik Kim, Seoul (KR)

(73) Assignee: Session Man Co., Ltd., Seoul (KR)

( * ) Notice: Subject to any disclaimer, the term of this patent is extended or adjusted under 35 U.S.C. 154(b) by 0 days.

(21) Appl. No.: 16/322,131

(22) PCT Filed: Jul. 20, 2017

(86) PCT No.: PCT/KR2017/007848

§ 371 (c)(1),
(2) Date: Jan. 31, 2019

(87) PCT Pub. No.: WO2018/026123

PCT Pub. Date: Feb. 8, 2018

(65) Prior Publication Data

US 2019/0189090 A1 Jun. 20, 2019

(30) Foreign Application Priority Data

Aug. 3, 2016 (KR) ..... 10-2016-0098901
Feb. 24, 2017 (KR) ..... 10-2017-0024621

(51) Int. Cl.

| | |
|---|---|
| ***G10D 1/00*** | (2020.01) |
| ***G10D 1/08*** | (2006.01) |
| ***G10D 3/02*** | (2006.01) |
| ***G10D 3/14*** | (2020.01) |
| ***G10D 3/06*** | (2020.01) |
| ***G10D 3/12*** | (2020.01) |

(52) U.S. Cl.
CPC ..... *G10D 1/085* (2013.01); *G10D 1/08* (2013.01); *G10D 3/02* (2013.01); *G10D 3/06* (2013.01); *G10D 3/12* (2013.01); *G10D 3/14* (2013.01)

(58) Field of Classification Search
CPC ..... G10D 1/085; G10D 3/06; G10D 3/12; G10D 3/02; G10D 3/14; G10D 1/08; G10D 3/00
See application file for complete search history.

(56) References Cited

U.S. PATENT DOCUMENTS 4,364,298 A 12/1982 Piazza
5,347,904 A 9/1994 Lawrence
(Continued)

FOREIGN PATENT DOCUMENTS

JP 3174638 U 3/2012
KR 200399201 Y1 10/2005

*Primary Examiner* — Kimberly R Lockett
(74) *Attorney, Agent, or Firm* — Jake K. Lee

(57) ABSTRACT

Disclosed is a guitar with a replaceable soundbox. The guitar with a replaceable soundbox according to the present invention comprises: a soundbox; a neck having a neck hill that protrudes therefrom and is detachably coupled to one side of the soundbox, and having a plurality of strings disposed to hold chords in accordance with a scale and harmony; a bridge detachably coupled to the soundbox such that one end of the plurality of strings is fixed; a playing part including a head extended to the neck such that the other end of the plurality of strings is fixed; and an adjustment part, coupled on the head, for adjusting the tension of the plurality of strings to increase or decrease.

8 Claims, 6 Drawing Sheets

(56) References Cited

U.S. PATENT DOCUMENTS

| | | | | |
|---|---|---|---|---|
| 7,687,698 | B2 * | 3/2010 | Kim | G10D 3/06 84/267 |
| 2003/0164080 | A1 * | 9/2003 | Childress | G10D 1/00 84/291 |
| 2003/0226440 | A1 | 12/2003 | Sawhney | |

* cited by examiner

GUITAR WITH REPLACEABLE SOUNDBOX

CROSS-REFERENCE TO RELATED APPLICATIONS

This application is a national stage application of International Patent Application No. PCT/KR2017/007848 filed on Jul. 20, 2017, which claims priority to Korean Patent Application No. 10-2016-0098901 filed on Aug. 3, 2016 and Korean Patent Application No. 10-2017-0024621 filed on Feb. 24, 2017, the entire contents of which are incorporated by reference herein.

TECHNICAL FIELD

The present invention relates to a guitar with a replaceable soundbox, and more particularly, to a guitar with a replaceable soundbox which has an adjustment part to adjust tension of a plurality of strings so that a neck and a bridge can be attached to or detached from the soundbox, thereby being applicable to various kinds of soundboxes.

BACKGROUND

In general, a guitar includes: a soundbox for generating resonant sounds by an echo of the guitar; a neck having a plurality of strings arranged to hold chords in accordance with a scale and harmony; and a head for connecting the strings and a bridge for fixing the strings in order to adjust the pitches.

The soundbox having the greatest impact on sounds is manufactured through the steps of: processing front and rear plates and a side plate into an approximately calabash shape using a hard wood with the straight grain; attaching a front cross section of the side plate on the inner face of an edge of the front plate; and attaching a rear cross section of the side plate on the inner face of an edge of the rear plate in such a way that the inside of the soundbox is entirely sealed except a sound hole formed in the front plate.

Because the soundbox mostly has the neck and the bridge which are connected integrally with each other, players select a guitar for the purpose of playing the guitar, but in order to play the guitar for the purpose of playing the guitar, players must buy guitars of various types individually, and it increases burden of expenses.

SUMMARY

Accordingly, the present invention has been made in view of the above-mentioned problems occurring in the prior art, and it is an object of the present invention to provide a guitar with a replaceable soundbox which has an adjustment part to adjust tension of a plurality of strings so that a neck and a bridge can be attached to or detached from the soundbox, thereby being applicable to various kinds of soundboxes.

It is another object of the present invention to provide a guitar with a replaceable soundbox including a silent bar, which is small in volume and low in sound, instead of the soundbox, thereby being used for practice or for trips.

To accomplish the above object, according to the present invention, there is provided a guitar with a replaceable soundbox including: a soundbox; a playing part including a neck, which has a neck hill protruding to be detachably coupled to one side of the soundbox, and a plurality of strings arranged to hold chords in accordance with a scale and harmony, a bridge detachably coupled to the soundbox such that one end of the plurality of strings is fixed to the bridge, and a head extended to the neck such that the other end of the plurality of strings is fixed; and an adjustment part for adjusting tension of the plurality of strings to increase or decrease.

In this instance, the soundbox includes electromagnets embedded therein at positions corresponding to the neck hill and the bridge, and the neck hill and the bridge include magnetic substances detachably coupled to the electromagnets according to power supply to the electromagnets.

In another aspect of the present invention, there is provided a guitar with a replaceable soundbox including: a silent bar; a playing part including a neck, which has a neck hill protruding to be detachably coupled to one side of the silent bar, and a plurality of strings arranged to hold chords in accordance with a scale and harmony, a bridge detachably coupled to the silent bar such that one end of the plurality of strings is fixed to the bridge, and a head extended to the neck such that the other end of the plurality of strings is fixed; and an adjustment part coupled to the head to adjust tension of the plurality of strings to increase or decrease. The silent bar includes: a neck hill fixing member having an end portion coupled with the neck hill of the neck, wherein a guide bar protrudes from the other end portion of the neck hill fixing member; a bridge fixing member coupled with the bridge; and an operation member interposed between the neck hill fixing member and the bridge fixing member, wherein one end portion of the operation member is slidably coupled to the guide bar and the other end portion is hinge-coupled to the bridge fixing member.

In this instance, the neck hill fixing member and the bridge fixing member include electromagnets embedded therein at positions corresponding to the neck hill and the bridge, and the neck hill and the bridge include magnetic substances detachably coupled to the electromagnets according to power supply to the electromagnets.

Moreover, the adjustment part includes: a first moving member having a handle formed at an end portion thereof, screw-coupled such that the other end portion is inserted from the head into the opposite side where the strings are arranged, and moved from side to side depending on rotation; a second moving member coupled to the other end portion of the first moving member such that one end portion of the second moving member idles, wherein the other end portion goes in and out toward the side where the strings are arranged from the head depending on movement of the first moving member; and a support member coupled to the other end portion of the second moving member in such a way as to cross the strings in the longitudinal direction, so that tension of the strings is adjusted in a lump by movement of the second moving member.

Furthermore, the guitar with a replaceable soundbox further includes a pair of guide parts coupled to the head to surround the plurality of strings and spaced apart from each other with respect to the adjustment part such that intervals of the plurality of strings are maintained when tension of the strings increases or decreases by the adjustment part.

As described above, the guitar with a replaceable soundbox according to the present invention includes the adjustment part to control tension of a plurality of the strings so that the playing part can be attached to or detached from the soundbox, thereby being applicable to various kinds of soundboxes and reducing burden of expenses since there is no need to buy guitars of various kinds.

Additionally, the guitar with a replaceable soundbox according to the present invention includes the silent bar, which is small in volume and low in sound, instead of the soundbox, thereby being used for practice or for trips.

Figure 1A:
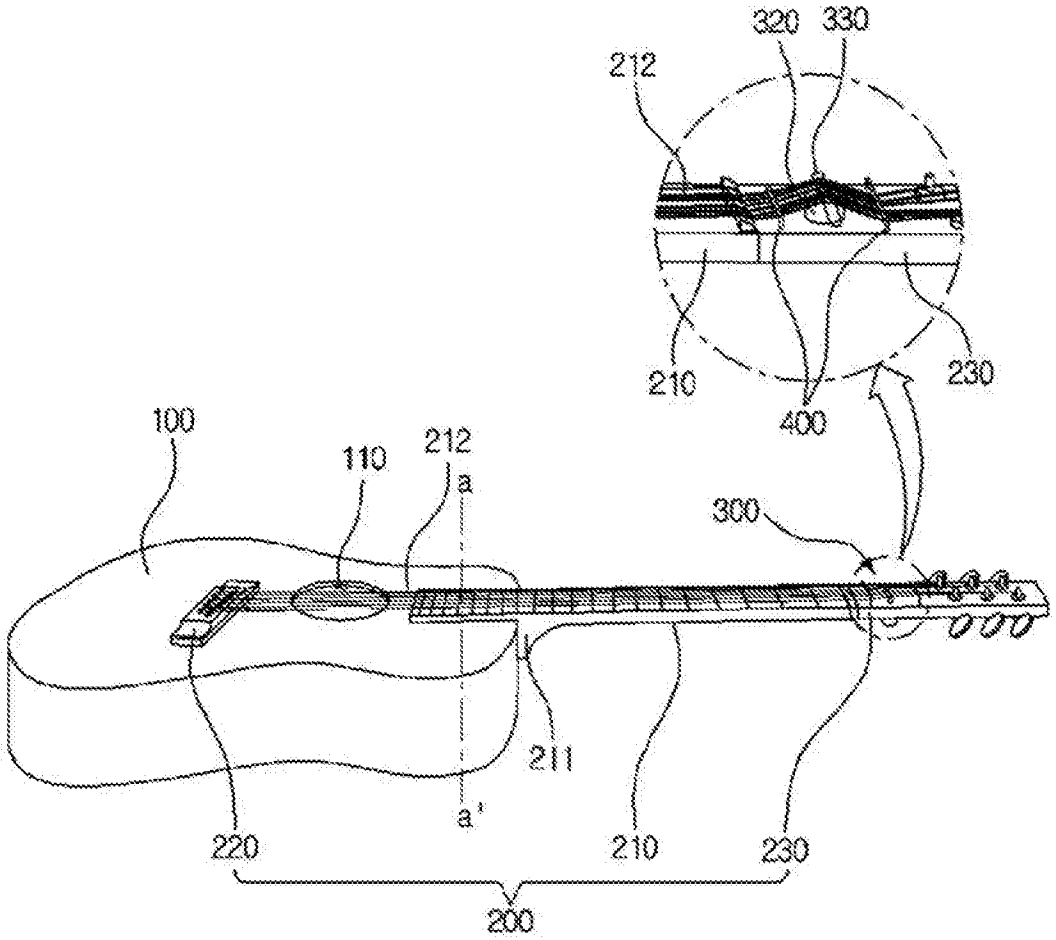
FIGS. 1A and 1B are perspective views of a guitar with a replaceable soundbox according to a first preferred embodiment of the present invention.

| Explanation of Reference Numerals in Drawings | |
|---|---|
| 100: Soundbox | 110: Sound hole |
| 120: Electromagnet | 130: Switch |
| 200: Neck hill | 210: Neck |
| 220: Bridge | 230: Head |
| 240: Magnetic substance | 300: Adjustment part |
| 310: First moving member | 311: Handle |
| 320: Second moving member | 330: Support member |
| 400: Silent bar | 410: Neck fixing member |
| 430: Actuating member | 440: Electromagnet |
| 450: Switch | |

DETAILED DESCRIPTION OF THE DISCLOSURE

Hereinafter, preferred embodiments of the present invention will be described in detail with reference to the accompanying drawings. However, such embodiments of the present invention are to describe the present invention in detail such that those skilled in the art can implement the present invention easily, and the technical idea and scope of the present invention are not limited to the embodiments described herein.

In addition, parts irrelevant to description are omitted in the drawings in order to clearly explain embodiments of the present invention. Similar parts are denoted by similar reference numerals throughout this specification.

Moreover, when a certain part "includes" a certain component, other components are not excluded unless explicitly described otherwise, and other components may in fact be included.

Embodiment 1

Figure 1B:
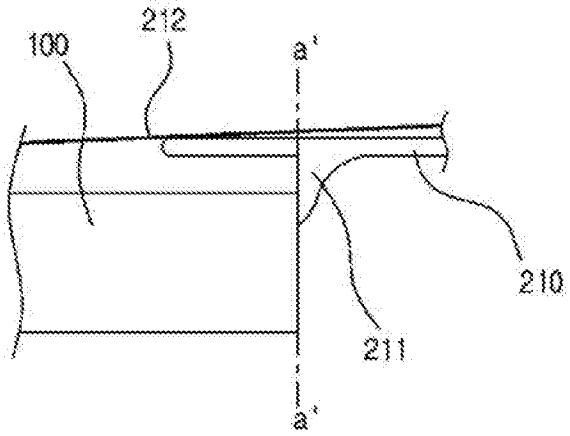
Figure 2:
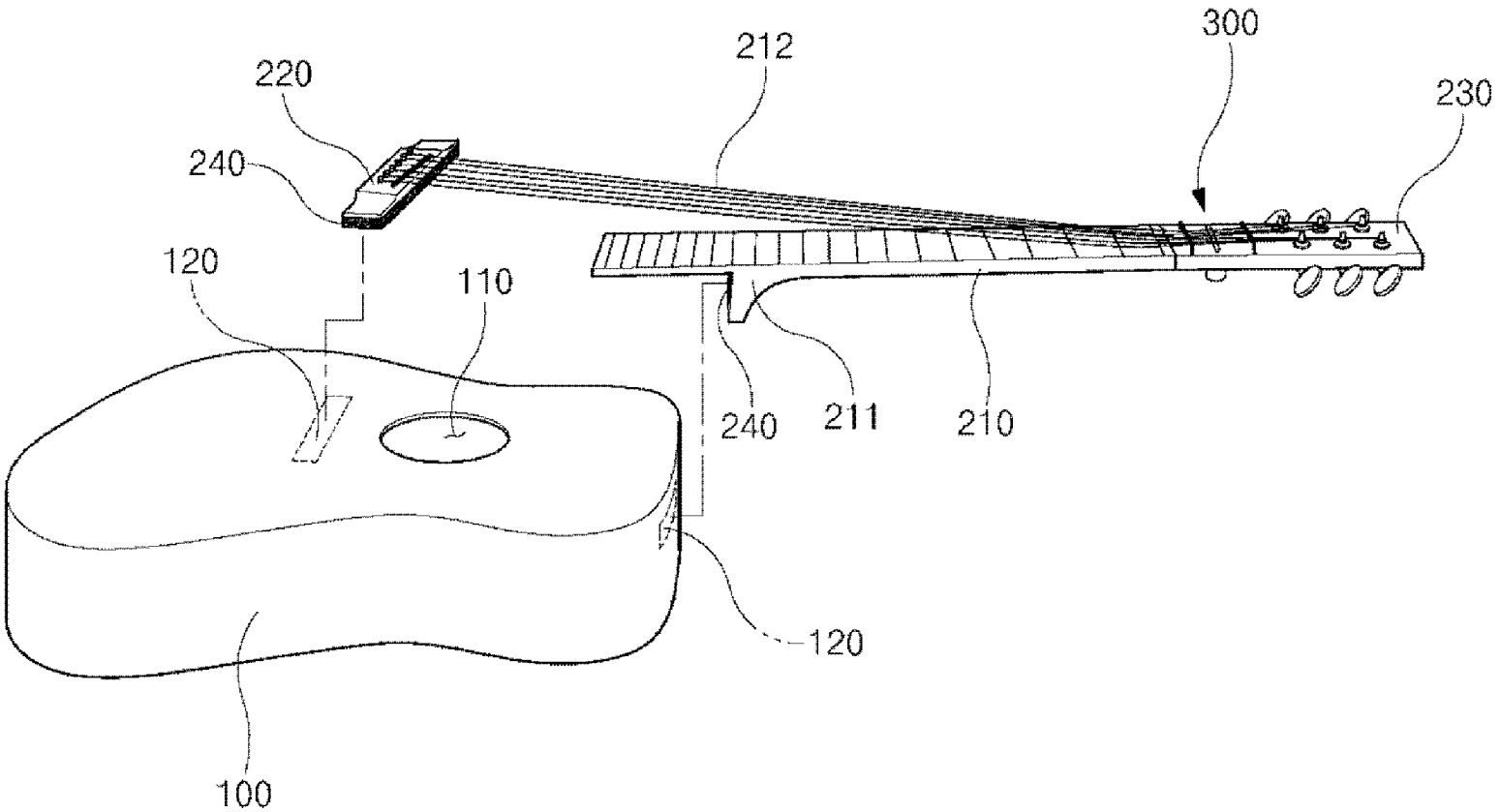
FIG. 2 is an exploded perspective view of the guitar with a replaceable soundbox illustrated in FIG. 1A.
Figure 3:
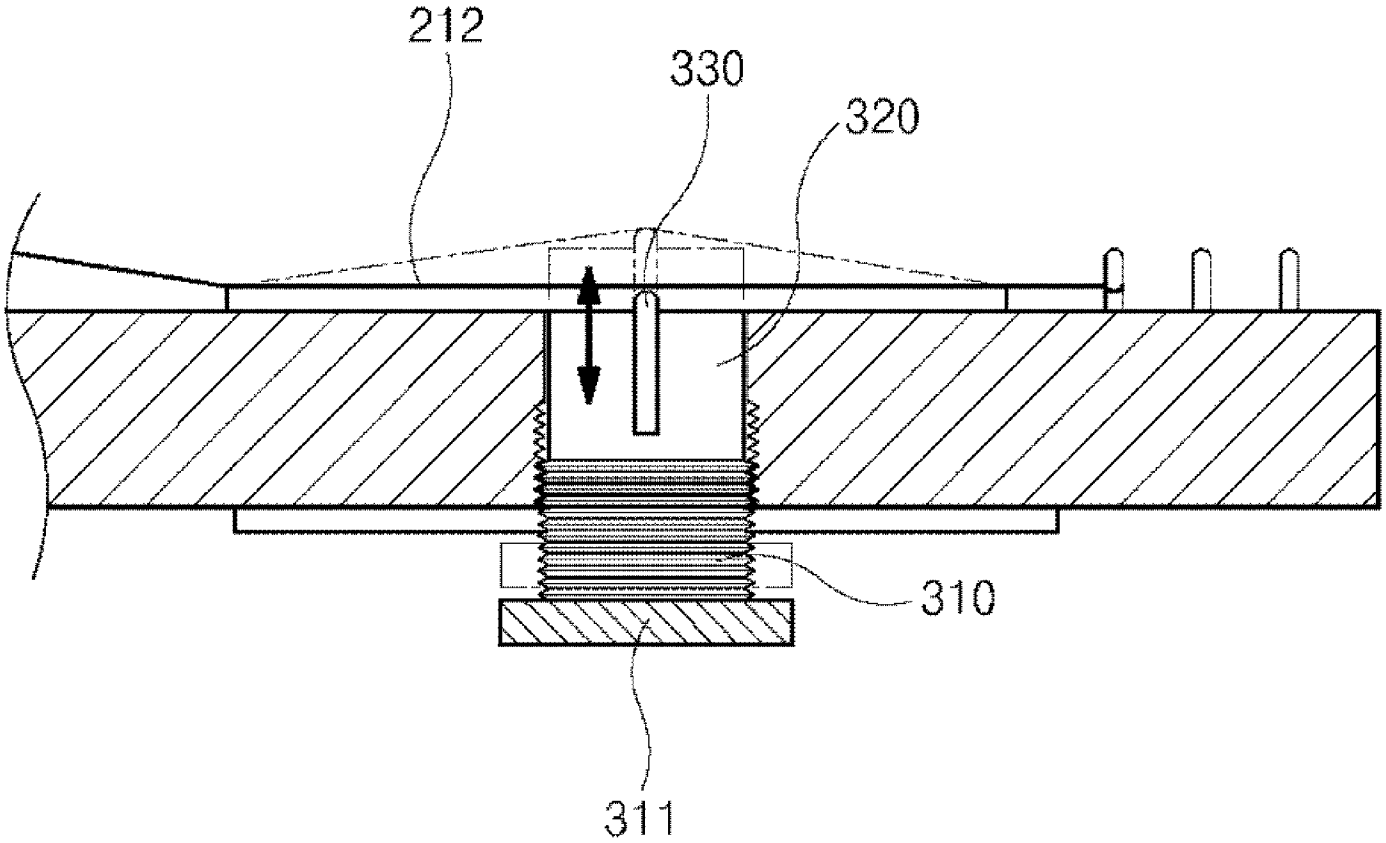
FIG. 3 is a sectional view showing operation of an adjustment part of the guitar with a replaceable soundbox illustrated in FIG. 1A.

FIGS. 1A and 1B are perspective views of a guitar with a replaceable soundbox according to a first preferred embodiment of the present invention, FIG. 2 is an exploded perspective view of the guitar with a replaceable soundbox illustrated in FIG. 1A, and FIG. 3 is a sectional view showing operation of an adjustment part of the guitar with a replaceable soundbox illustrated in FIG. 1A.

As shown in FIGS. 1 to 3, the guitar with a replaceable soundbox according to the first preferred embodiment of the present invention includes a soundbox 100, a playing part 200, and an adjustment part 300.

Here, the soundbox 100 is detachably coupled to the playing part 200 through the adjustment part 300 and has a sound hole 110 for amplifying sound during playing.

In this instance, a player may select one among soundboxes of various guitars in order to generate a specific sound according to playing the guitar.

For instance, the player may select a soundbox among soundboxes for general acoustic guitars or electric guitars or a soundbox among soundboxes for guitar-family string instruments, such as lutes, ukuleles or others.

In order to play an acoustic guitar, a player couples the playing part 200 to the soundbox 100 of the acoustic guitar using the adjustment part 300. Alternatively, in order to play an electric guitar, the player couples the playing part 200 to the sound box 100 of the electric guitar using the adjustment part 300.

Moreover, the playing part 200 serves to be detachably coupled to the soundbox 100 by the adjustment part 300.

In detail, the playing part 200 includes: a neck 210 having a neck hill 211 to be coupled to one side of the soundbox 100 and a plurality of strings 212 for holding cords in accordance with a scale and harmony; a bridge 220 detachably coupled to the soundbox 100 to fix one end portion of the plurality of strings 212; and a head 230 extending to the neck 210 to fix the other end portion of the plurality of strings 212.

In the meantime, as shown in FIG. 2, the soundbox 100 may further include electromagnets 120 embedded therein at positions corresponding to the neck hill 211 and the bridge 220, and the neck hill 211 and the bridge 220 may include magnetic substances 240 detachably coupled to the electromagnets 120 according to power supply of the electromagnets 120.

The electromagnets 120 may be permanent electromagnets which controls magnetic force by electric current.

That is, when electric current is supplied to the electromagnets 120, the permanent electromagnets lose magnetic force, so the neck hill 211 and the bridge 220 are separated from the soundbox 100 by electromagnetic force.

On the contrary, when electric current to the electromagnets 120 is interrupted, the neck hill 211 and the bridge 220 keep the state where they are coupled to the soundbox 100 by the magnetic force of the electromagnets 120.

Therefore, the guitar with a replaceable soundbox according to the present invention allows the player to quickly attach and detach the soundbox 100 and the playing part 200 with a little power, and allows the player to play guitars of various kinds since being applicable to various soundboxes 100.

In this instance, preferably, the guitar with a replaceable soundbox according to the present invention may further include an auxiliary coupling means (not shown).

If combination of the neck hill 211, the bridge 220 and the soundbox 100 is achieved just by the magnetic force of the electromagnets 120, because volume and weight of the electromagnets 120 may be increased excessively or the neck hill 211, the bridge 220 and the soundbox 100 may be separated from one another during the use.

Therefore, the neck hill 211 and the bridge 220 are fixed by the auxiliary coupling means in safety in the state where they are coupled to the soundbox 100. Such an auxiliary coupling means may be well-known members, such as safety pins or bolts.

In the meantime, as shown in FIG. 1B, in the state where the neck hill 211 and the bridge 220 are coupled to the soundbox 100, an end portion of the neck 210 opposed to the head 230 is spaced apart from the surface of the soundbox 100 at a predetermined interval.

If the interval is not kept, noise may be generated by vibration of the neck 210 and the surface of the soundbox 100.

Furthermore, because the neck 210 opposed to the head 230 is spaced apart from the surface of the soundbox 100 at a predetermined interval, the soundbox 100 may generate more echo at the front plate, and it makes resonant sound better.

Meanwhile, the soundbox 100 further includes a switch 130 mounted to control supply of electric current of the electromagnets 120, and a battery (not shown) embedded therein to supply electric current to the electromagnets 120. Additionally, a power cable may be connected to the soundbox 100.

Here, the location of the switch 130 is not specifically limited, and may be mounted on the outer face of the soundbox 100 or on the inner face of the soundbox 100 near to the sound hole 110.

In this instance, if the switch 130 is mounted on the inner face of the soundbox 100, it has a merit in that the soundbox 100 is not separated by the player's carelessness since it is hardly possible that the player presses the switch 130 during playing the guitar.

In the meantime, the adjustment part 300 serves to adjust tension of the plurality of strings 212 so that the playing part 200 is detachably coupled to the soundbox 100, and includes a first moving member 310, a second moving member 320 and a support member 330 as shown in FIG. 3.

That is, the adjustment part 300 decreases tension of the strings 212 in order to separate the playing part 200 from the soundbox 100, but increases tension of the strings 212 in order to allow the player to play the guitar in the state where the playing part 200 is coupled to the soundbox 100.

In detail, the first moving member 310 has a handle 311 formed at an end portion thereof for rotation, and is screw-coupled such that the other end portion is inserted from the head 230 into the opposite side where the strings 212 are arranged so that the first moving member moves depending on rotation.

The second moving member 320 goes in and out toward the side where the strings 212 are arranged from the head 230 depending on movement of the first moving member 310.

In this instance, when the second moving member 320 is coupled to be rotated by rotation of the first moving member 310, because the support member 330 goes into and out of the head 230 in a state where the support member 330 gets in contact with the strings 212, it is difficult to rotate the first moving member 310 and the plurality of string 212 are damaged.

So, it is preferable that one end portion of the second moving member 320 be coupled to the other end portion of the first moving member 310 to idle so that the second moving member moves smoothly in the state where it gets in contact with the strings 212 without being influenced by rotation of the first moving member 310.

The support member 330 is coupled to the other end portion of the second moving member 320 in such a way as to cross the strings 212 in the longitudinal direction, so that tension of the strings 212 can be adjusted in a lump by movement of the second moving member 320.

In the meantime, while tension of the strings 212 increases by the adjustment part 300, if movement of the strings 212 is not limited, the strings 212 may be separated from the support member 330.

Therefore, the guitar may further include a pair of guide parts 400 coupled to the head 230 to surround the strings 212 and spaced apart from each other with respect to the adjustment part 300.

That is, because the guide parts 400 limit movement of the strings 212, if tension of the strings 212 increases by the adjustment part 300, the strings 212 are not separated from the support member 330 and maintain the predetermined interval.

Embodiment 2

Figure 4:
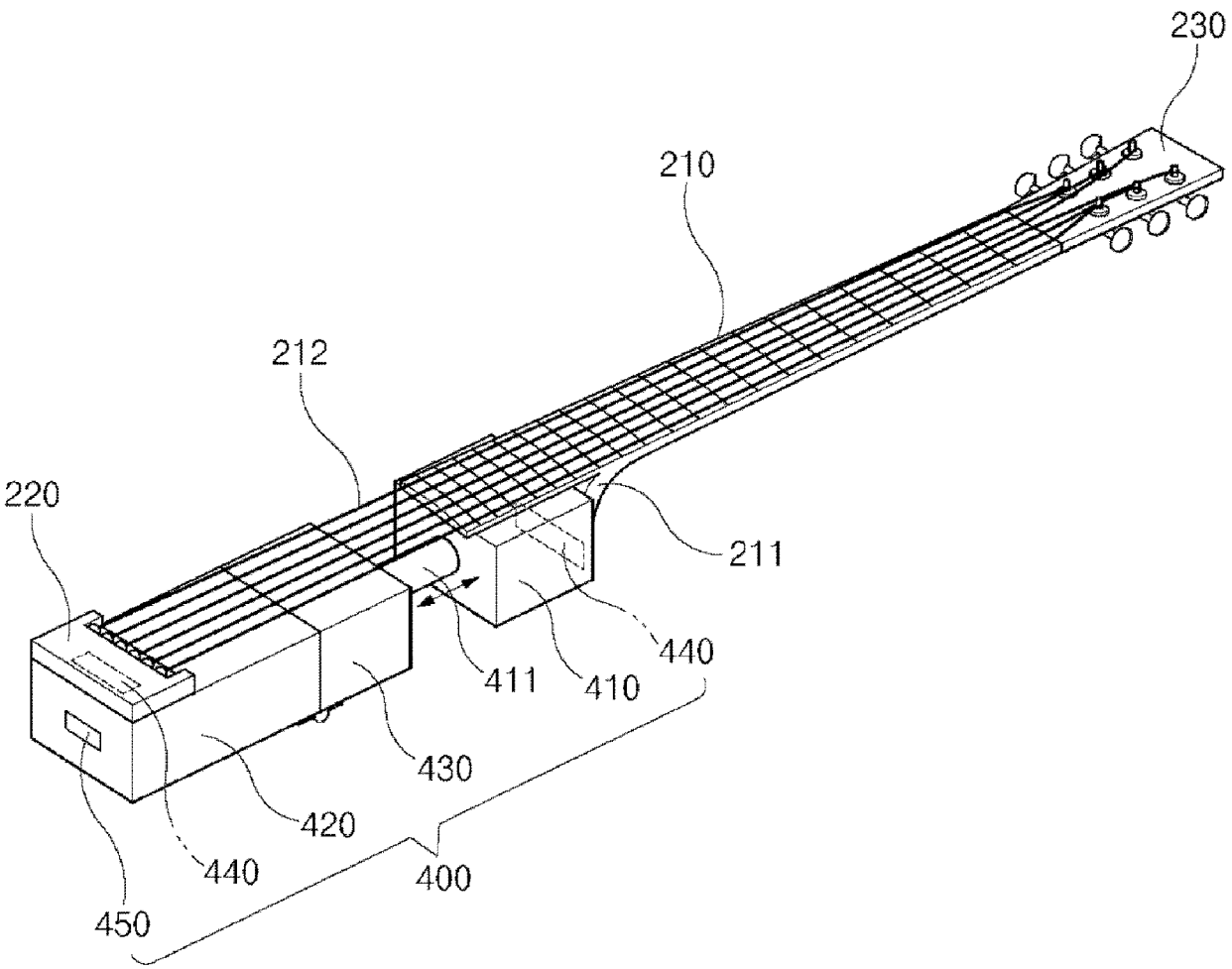
FIG. 4 is a perspective view of a guitar with a replaceable soundbox according to a second preferred embodiment of the present invention.
Figure 5:
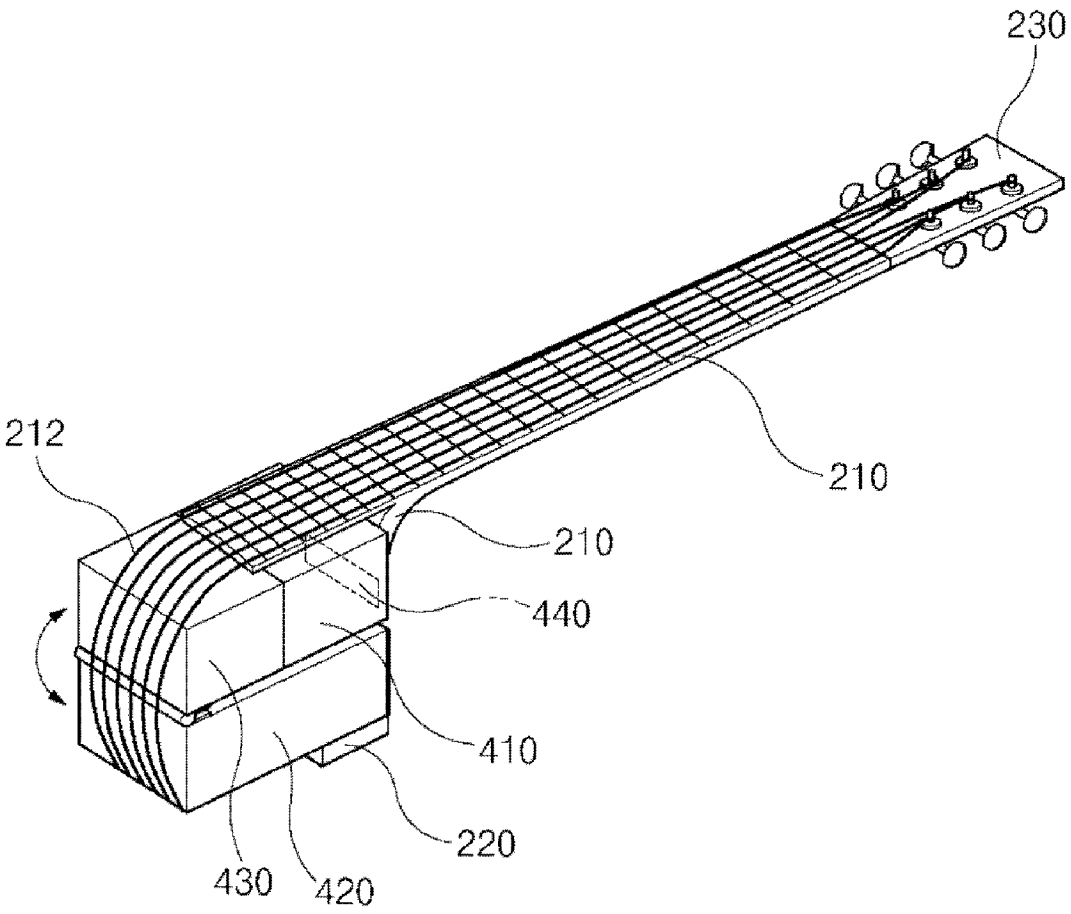
FIG. 5 is an exploded perspective view of the guitar with a replaceable soundbox illustrated in FIG. 4.

FIG. 4 is a perspective view of a guitar with a replaceable soundbox according to a second preferred embodiment of the present invention, and FIG. 5 is an exploded perspective view of the guitar with a replaceable soundbox illustrated in FIG. 4.

As shown in FIGS. 4 and 5, the guitar with a replaceable soundbox according to the second preferred embodiment of the present invention includes a silent bar 400, a playing part 200 and an adjustment part 300.

The guitar with a replaceable soundbox according to the second preferred embodiment of the present invention is different from the guitar with a replaceable soundbox according to the first preferred embodiment of the present invention in that the silent bar 400 is replaced with the soundbox 100, but is similar to or the same as that of the first preferred embodiment in the general structure and action. So, because the guitar with a replaceable soundbox according to the second preferred embodiment of the present invention may be deduced from the description of the guitar with a replaceable soundbox according to the first preferred embodiment, just the silent bar 400 will be described.

Here, the silent bar 400 includes a neck hill fixing member 410, a bridge fixing member 420, and an operation member 430.

In detail, the neck hill fixing member 410 is coupled with the neck hill 211 of the neck 210 and has a hexahedral shape with the same width as the neck 210. One end portion of the neck hill fixing member 410 is coupled to the neck hill 211, and a guide bar 411 protrudes from the other end portion of the neck hill fixing member 410.

Moreover, the bridge fixing member 420 is coupled with the bridge 220, and has a hexahedral shape with the same width as the neck 210.

Not shown in the drawings, but an amplifier terminal may be disposed at one side of the bridge fixing member 420 to allow the user to connect an amplifier thereto to be used when the player plays the guitar.

Furthermore, the operation member 430 has a hexahedral shape with the same width as the neck 210 and is interposed between the neck hill fixing member 410 and the bridge fixing member 420. One end portion of the operation member 430 is slidably coupled to the guide bar 411, and the other end portion is hinge-coupled to the bridge fixing member 420.

That is, when the operation member 430 slides toward the bridge fixing member 420 in a state where the bridge fixing member 420 is stretched, the guitar is in an available state. When the bridge fixing member 420 is rotated in a state where tension of the strings 212 is released after the operation member 430 moves toward the neck hill fixing member 410, the bridge fixing member 420 is folded.

Therefore, the silent bar 400 is reduced in volume and weight and reduces sound when the guitar is played, so that the guitar is appropriate for practice and trips.

In this instance, the neck hill fixing member 410 and the bridge fixing member 420 include electromagnets 440 embedded therein at positions corresponding to the neck hill 211 and the bridge 220, and the neck hill 211 and the bridge 220 may include magnetic substances 240 detachably coupled to the electromagnets 440 according to power supply of the electromagnets 440.

Moreover, like the soundbox 100, the silent bar 400 further includes a switch 450 to control supply of electric current to the electromagnets 440, and a battery (not shown) embedded therein to supply electric current to the electromagnets 440. Additionally, a power cable may be connected to the silent bar 400.

Therefore, the guitar with a replaceable soundbox according to the present invention allows the player to quickly attach and detach the silent bar 400 and the playing part 200 with a little power, and allows the player to play guitars of various kinds since being applicable to various soundboxes 100.

In the meantime, in this specification, it is described that the adjustment part 300 is disposed on the head 230, but the position of the adjustment part 300 is not limited to the head 230 and the adjustment part 300 may be disposed at any position if the adjustment part 300 is located on a path of the strings 212.

What is claimed is:

1. A guitar with a replaceable soundbox comprising:

a soundbox;

a playing part including a neck, which has a neck hill protruding to be detachably coupled to one side of the soundbox, and a plurality of strings arranged to hold chords in accordance with a scale and harmony, a bridge detachably coupled to the soundbox such that one end of the plurality of strings is fixed to the bridge, and a head extended to the neck such that the other end of the plurality of strings is fixed; and an adjustment part for adjusting tension of the plurality of strings to increase or decrease, wherein the soundbox includes electromagnets embedded therein at positions corresponding to the neck hill and the bridge, and the neck hill and the bridge include magnetic substances detachably coupled to the electromagnets according to power supply to the electromagnets.

2. A guitar with a replaceable soundbox comprising:

a soundbox;

a playing part including a neck, which has a neck hill protruding to be detachably coupled to one side of the soundbox, and a plurality of strings arranged to hold chords in accordance with a scale and harmony, a bridge detachably coupled to the soundbox such that one end of the plurality of strings is fixed to the bridge, and a head extended to the neck such that the other end of the plurality of strings is fixed; and an adjustment part for adjusting tension of the plurality of strings to increase or decrease, wherein the adjustment part comprises:

a first moving member having a handle formed at an end portion thereof, screw-coupled such that the other end portion is inserted from the head into the opposite side where the strings are arranged, and moved from side to side depending on rotation;

a second moving member coupled to the other end portion of the first moving member such that one end portion of the second moving member idles, wherein the other end portion goes in and out toward the side where the strings are arranged from the head depending on movement of the first moving member; and a support member coupled to the other end portion of the second moving member in such a way as to cross the strings in the longitudinal direction, so that tension of the strings is adjusted in a lump by movement of the second moving member.

3. The guitar according to claim 1, further comprising:

a pair of guide parts coupled to the head to surround the plurality of strings and spaced apart from each other with respect to the adjustment part such that intervals of the plurality of strings are maintained when tension of the strings increases or decreases by the adjustment part.

4. A guitar with a replaceable soundbox comprising:

a silent bar;

a playing part including a neck, which has a neck hill protruding to be detachably coupled to one side of the silent bar, and a plurality of strings arranged to hold chords in accordance with a scale and harmony, a bridge detachably coupled to the silent bar such that one end of the plurality of strings is fixed to the bridge, and a head extended to the neck such that the other end of the plurality of strings is fixed; and an adjustment part coupled to the head to adjust tension of the plurality of strings to increase or decrease.

5. The guitar according to claim 4, wherein the silent bar comprises:

a neck hill fixing member having an end portion coupled with the neck hill of the neck, wherein a guide bar protrudes from the other end portion of the neck hill fixing member;

a bridge fixing member coupled with the bridge; and an operation member interposed between the neck hill fixing member and the bridge fixing member, wherein one end portion of the operation member is slidably coupled to the guide bar and the other end portion is hinge-coupled to the bridge fixing member.

6. The guitar according to claim 4, wherein the neck hill fixing member and the bridge fixing member include electromagnets embedded therein at positions corresponding to the neck hill and the bridge, and the neck hill and the bridge include magnetic substances detachably coupled to the electromagnets according to power supply to the electromagnets.

7. The guitar according to claim 4, wherein the adjustment part comprises:

a first moving member having a handle formed at an end portion thereof, screw-coupled such that the other end portion is inserted from the head into the opposite side where the strings are arranged, and moved from side to side depending on rotation;

a second moving member coupled to the other end portion of the first moving member such that one end portion of the second moving member idles, wherein the other end portion goes in and out toward the side where the strings are arranged from the head depending on movement of the first moving member; and a support member coupled to the other end portion of the second moving member in such a way as to cross the strings in the longitudinal direction, so that tension of the strings is adjusted in a lump by movement of the second moving member.

8. The guitar according to claim 4, further comprising:

a pair of guide parts coupled to the head to surround the plurality of strings and spaced apart from each other with respect to the adjustment part such that intervals of the plurality of strings are maintained when tension of the strings increases or decreases by the adjustment part.

* * * * *